US007730949B2

(12) United States Patent
Guignard et al.

(10) Patent No.: US 7,730,949 B2
(45) Date of Patent: Jun. 8, 2010

(54) SYSTEM AND METHOD FOR PERFORMING WELL TREATMENTS

(75) Inventors: Thibaut Guignard, Houston, TX (US); John R. Whitsitt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/846,203

(22) Filed: Sep. 20, 2007

(65) Prior Publication Data

US 2009/0078421 A1 Mar. 26, 2009

(51) Int. Cl.
*E21B 43/10* (2006.01)

(52) U.S. Cl. ..... 166/296; 166/55.2; 166/55.3

(58) Field of Classification Search ..... 166/296, 166/298, 55.2, 55.3, 227, 313, 233
See application file for complete search history.

(56) References Cited

U.S. PATENT DOCUMENTS 602,301 A * 4/1898 Bramlette ..... 166/55.3
2,023,064 A * 12/1935 Clasen et al. ..... 166/55.2
3,176,770 A * 4/1965 Ehlert ..... 166/55.1
3,221,815 A * 12/1965 Myers ..... 166/55.3
4,401,158 A 8/1983 Spencer
4,428,431 A * 1/1984 Landry et al. ..... 166/298
5,577,559 A 11/1996 Voll
5,579,844 A 12/1996 Rebardi
5,609,204 A 3/1997 Rebardi
5,791,409 A * 8/1998 Flanders ..... 166/55.8
5,865,251 A 2/1999 Rebardi
5,921,318 A 7/1999 Ross
5,988,285 A 11/1999 Tucker
6,405,800 B1 6/2002 Walker
6,446,729 B1 9/2002 Bixenman
6,464,006 B2 10/2002 Womble
6,464,261 B1 10/2002 Dybevik
6,488,082 B2 12/2002 Echols
6,722,440 B2 4/2004 Turner
6,932,156 B2 8/2005 Bayne
2004/0238173 A1 12/2004 Bissonnette
2006/0266524 A1 * 11/2006 Dybevik ..... 166/369

* cited by examiner

*Primary Examiner*—David J Bagnell
*Assistant Examiner*—Cathleen R Hutchins
(74) *Attorney, Agent, or Firm*—David G. Matthews; Van Someren, P.C.; Rodney V. Warfford

(57) ABSTRACT

A technique is provided for performing a well treatment operation. A completion assembly is constructed with a tubular member designed to maintain pressure integrity above a given well treatment zone. The completion assembly and a service tool can be moved downhole for well treatment operations in one or more well zones. A converter tool is utilized to selectively form openings through a wall of the tubular member to enable flow following completion of the well treatment in a lower zone.

23 Claims, 9 Drawing Sheets

SYSTEM AND METHOD FOR PERFORMING WELL TREATMENTS

BACKGROUND

Completion assemblies are used in a variety of well treatment operations. Generally, a completion assembly is positioned in a wellbore and a service tool is used in cooperation with the completion assembly to perform the well treatment. In some applications, the well treatment comprises a sand control operation in which a gravel pack is created in the annulus around the completion assembly. The gravel pack helps filter out sand and other particulates from a desired production fluid entering the wellbore.

In some well treatment applications, multiple well zones are treated along a wellbore. The treatment of multiple zones can be accomplished with multiple trips downhole, however this can be expensive and time-consuming. Multi-zone treatments have been attempted by making a single trip downhole with the completion assembly and service tool. However, difficulties arise in isolating zones to be treated. In a sand control application, for example, return fluids and reverse out fluids must be conveyed uphole from the formation being treated and past untreated zones. Relatively complex and/or limited flow paths have been constructed in an attempt to remove such fluids while isolating the untreated well zones.

SUMMARY

In general, the present invention provides a system and method for performing a well treatment operation. A completion assembly is constructed with a tubular member designed to maintain pressure integrity above a given well treatment zone. The completion assembly and a service tool are moved downhole to conduct one or more well treatment operations. Additionally, a converter tool is utilized to selectively form openings through a wall of the tubular member to enable flow following completion of the well treatment below.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a well system that can be used for well treatment operations, such as sand control operations. The system and methodology provide a technique for maintaining zonal isolation during a well treatment, particularly during a multi-zone well treatment. Temporary isolation of well zones above the region being treated can be maintained while maximizing the inside diameter of the completion and providing zonal accessibility at the end of the job. The system and methodology further provide the flexibility to subsequently deploy a selective production string within the lower completion assembly if required.

Furthermore, the zonal isolation is achieved in a very space efficient manner that enables greater pumping capabilities through an enlarged service string. The use of space limiting valves can be avoided. The system and methodology also can be used to eliminate a downhole packoff and a concentric string while providing conventional flow channels through completion screen assemblies. In a sand control treatment operation, for example, conventional flow channels can be provided to the screens for gravel placement and production rather than utilizing restrictive local flow channels through downhole valves at each screen assembly. However, the system and methodology can be used in a variety of other well treatment procedures.

Figure 1:
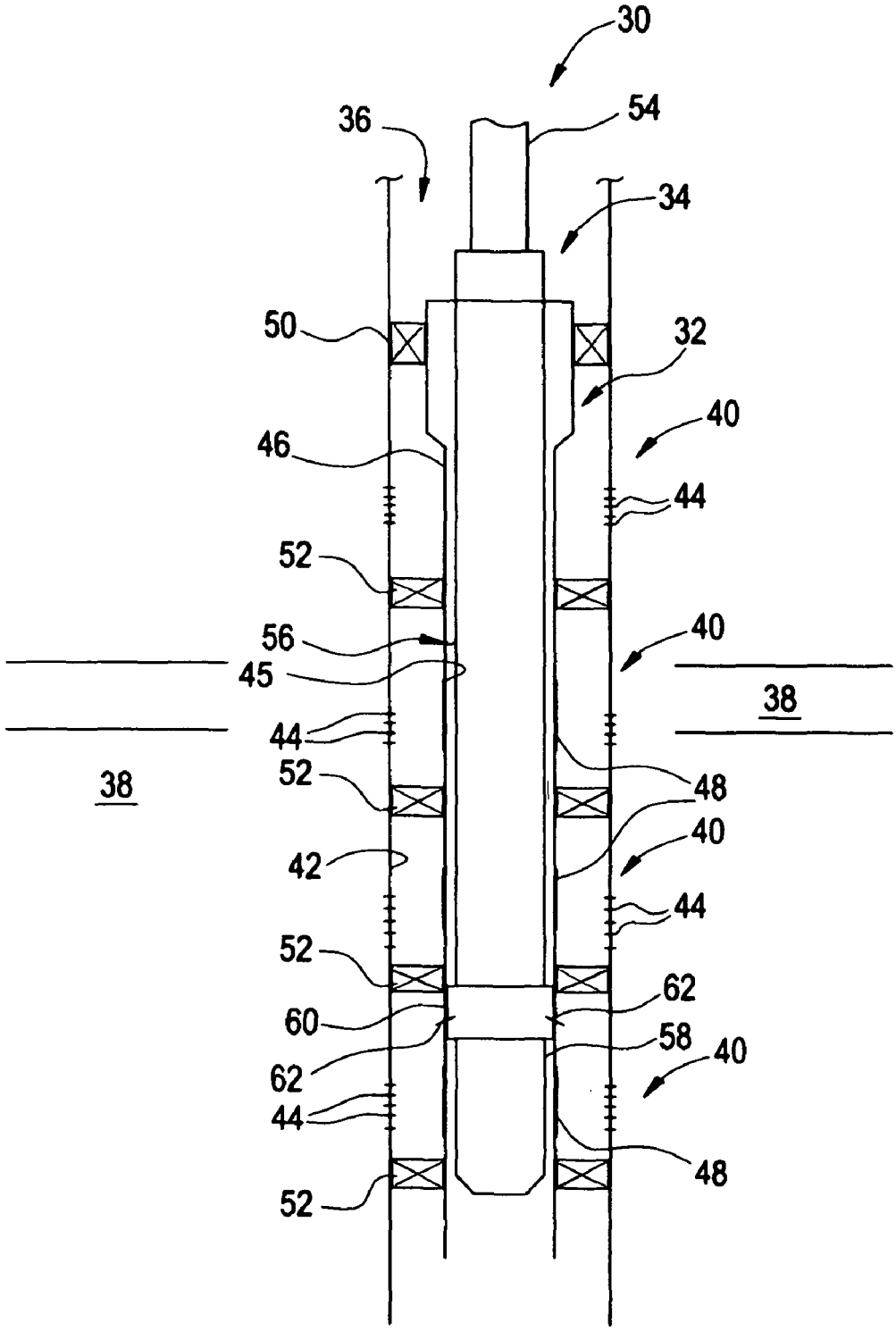
FIG. 1 is a front elevation view of a completion assembly and service tool deployed in a wellbore, according to an embodiment of the present invention.

Referring generally to FIG. 1, one embodiment of a well system 30 is illustrated. In this embodiment, well system 30 comprises a completion assembly 32 and a service string 34 deployed in a wellbore 36. The wellbore 36 is drilled into a subsurface formation 38 having one or more well zones 40 that may contain desirable production fluids, such as petroleum. In the example illustrated, wellbore 36 is lined with a casing 42. The casing 42 typically is perforated in a manner that places perforations 44 along each well zone 40. The perforations 44 enable flow of fluids into (or out of) wellbore 36 at each well zone 40. Although the present completion assembly and service tool can be used in single zone applications, they are amenable to use in well treatment, e.g. gravel packing, operations at multiple zones, as illustrated in FIG. 1.

In the embodiment illustrated, completion assembly 32 comprises a continuous internal passage referred to as a completion assembly central bore 45 defined within, for example, a tubular structure 46. Tubular structure 46 comprises screen assemblies 48 positioned at each well zone 40. The screen assemblies 48 initially are pressure competent and do not allow flow therethrough. However, the screen assemblies 48 may be selectively converted to enable fluid flow, e.g. to allow the inward flow of returning carrier fluid during a sand control treatment operation. The return fluid flows from the annulus surrounding the completion assembly 32 into the region between tubular structure 46 and service string 34 at the subject treatment zone. A packer 50, such as a GP packer, secures completion assembly 32 to wellbore casing 42. Additionally, a plurality of isolation packers 52 are positioned between completion assembly 32 and the surrounding casing 42 at predetermined locations to selectively isolate the well zones 40.

Service string 34 may be deployed downhole with completion assembly 32 on an appropriate conveyance 54, such as a tubing. The service string 34 may be attached to completion assembly 32 proximate the upper packer 50 or at another suitable location. Generally, service string 34 comprises an upper section 56 coupled to a service tool 58 through a crossover 60. Crossover 60 comprises one or more crossover exit ports 62 that are positioned adjacent corresponding circulating ports of completion assembly 32 to enable the flow of treatment fluid into the annulus surrounding completion assembly 32. In a gravel packing operation, gravel slurry is pumped down into this annulus at a given well zone, and the carrier or return fluid portion of the slurry is returned up along service string 34.

Figure 2:
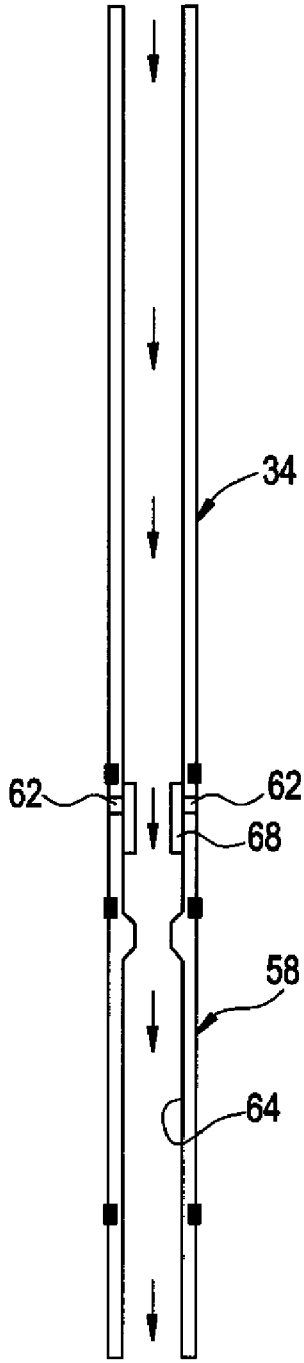
FIG. 2 is a schematic illustration of a service tool in a wash-down configuration, according to an embodiment of the present invention.
Figure 3:
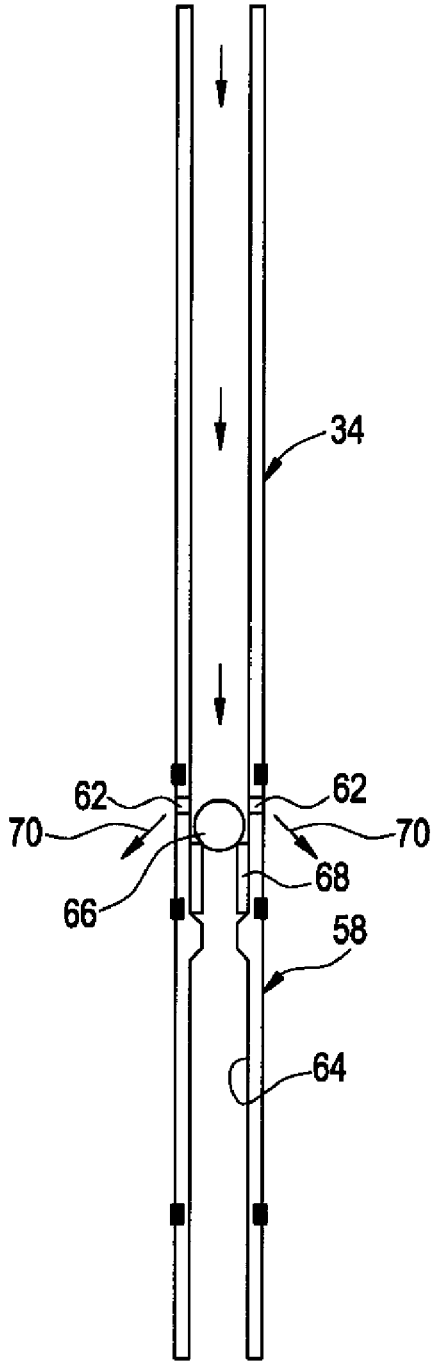
FIG. 3 is a schematic illustration of the service tool of FIG. 2 in a well treating configuration, according to an embodiment of the present invention.

During run-in, the service tool 58 may be maintained in a wash-down configuration that allows downward fluid flow through the service string and through an internal passage 64, as illustrated in FIG. 2. Once the wash-down is completed and service string 34 is positioned with completion assembly 32 in wellbore 36, further flow of fluid down through passage 64 of the washpipe is blocked, as illustrated in FIG. 3. By way of example, a blanking device 66, such as a ball, can be dropped onto a corresponding restriction 68, e.g. a shiftable ball seat, to block further downward flow through passage 64. However, a variety of other blocking mechanisms, e.g. valves, can be used to prevent this downward flow. Upon blocking downward flow through passage 64 of service tool 58, gravel slurry can be diverted radially outward through crossover exit ports 62, as indicated by arrows 70, to the desired well zone being treated.

Figure 4:
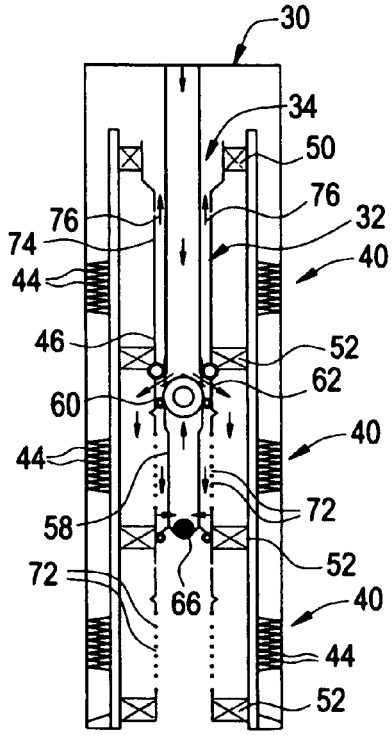
FIG. 4 is a schematic illustration of a completion assembly and service tool utilized in a multi-zone well, according to an embodiment of the present invention.

Referring generally to FIG. 4, a schematic illustration is provided to aid in explaining the concept of the present system and methodology. In this example, well system 30 is utilized in a multi-zone well with the various well zones 40 isolated by packers 50, 52. When a well zone 40 is to be treated, one or more openings 72 are formed through tubular member 46, e.g. a screen assembly, to enable the fluid flow. However, the pressure integrity of the well zones above the well zone 40 being treated is maintained, as illustrated by the solid section 74 of tubular member 46 above the treated well zones.

During treatment of a well zone, treatment fluid, e.g. gravel slurry, is pumped down through service string 34 and out into the surrounding annulus at the desired well zone via crossover 60. The fluid then flows inwardly through the one or more openings 72 into the region between service tool 58 and the surrounding portion of tubular member 46, e.g. a screen assembly. Subsequently, fluid is directed upwardly through crossover 60 and along the annulus formed between service string 34 and completion assembly 32, as indicated by arrows 76. Upon completing the servicing of the well zone 40, the service tool 58 is moved upwardly to the next well zone 40. Before, during or after the movement of service tool 58, openings are formed through solid section 74 to enable the flow of well treatment fluids, as described above. Thus, each subsequent well zone to be treated is converted to enable fluid flow while the pressure competence of the well zones uphole from the treatment area is maintained.

Figure 5:
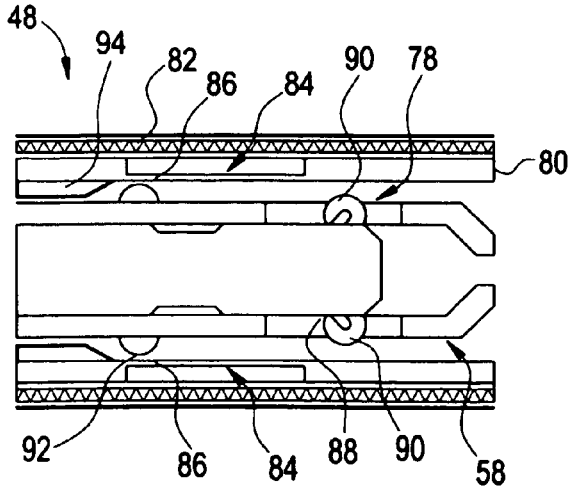
FIG. 5 is an illustration of one example of a well assembly having a converter tool mounted on a service tool within a completion assembly, according to an embodiment of the present invention.
Figure 6:
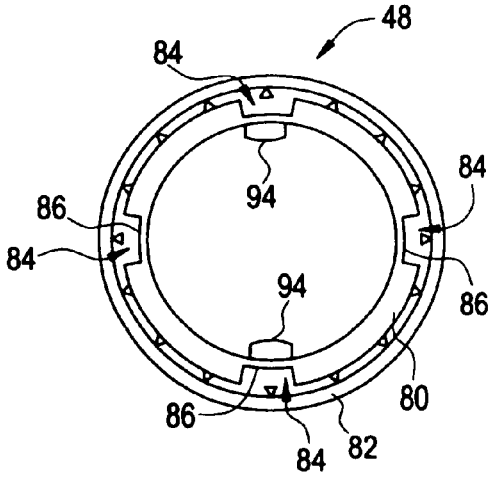
FIG. 6 is a cross-sectional view of the well assembly illustrated in FIG. 5 but without the service tool, according to an embodiment of the present invention.

One example of a converter tool 78 for selectively forming openings 72 in each subsequent well zone is illustrated in FIGS. 5-8. In this embodiment, openings 72 are formed via deformation of the material, e.g. mechanical deformation such as cutting of the material. Converter tool 78 may be mounted on service tool 58 and illustrated as positioned within a screen assembly 48. The illustrated screen assembly is formed initially with a base pipe 80 that is solid, e.g. a blank pipe, to maintain pressure integrity, as illustrated in FIGS. 5 and 6. The base pipe 80 is surrounded by a screen jacket 82. Depending on the application and the type of converter tool utilized, base pipe 80 may comprise one or more weakened areas 84 designed to facilitate the formation of openings 72 through base pipe 80. By way of example, weakened areas 84 may be created by forming thin wall sections 86 at specific locations along the base pipe 80.

In the embodiment illustrated, converter tool 78 comprises a cutter mechanism 88 having one or more cutters 90. The cutter mechanism 88 may be mounted on service tool 58 and selectively actuated between an enabled state for forming openings 72 and a disabled state for movement through the completion assembly. The cutter mechanism 88 of the converter tool can be moved to the enabled state by an appropriately positioned actuator 92, such as the mechanical actuator illustrated in FIG. 5.

Figure 7:
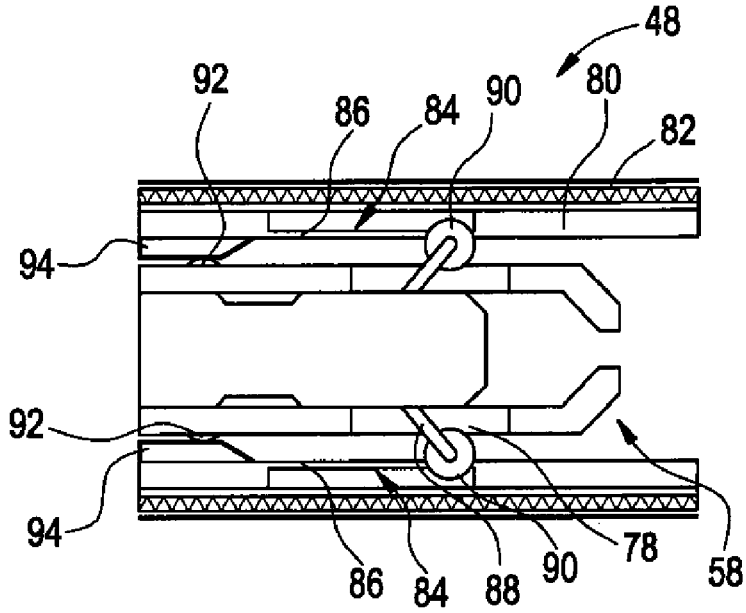
FIG. 7 is an illustration similar to that of FIG. 5 in which the converter tool has been actuated, according to an embodiment of the present invention.
Figure 8:
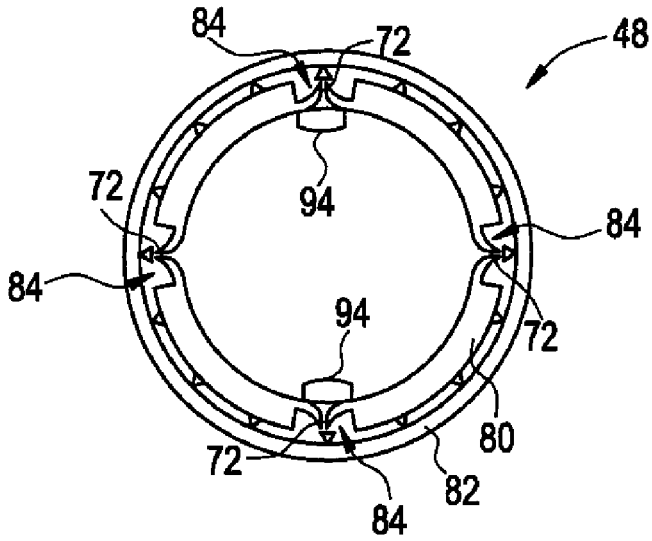
FIG. 8 is a cross-sectional view of the well assembly illustrated in FIG. 7 without the service tool and with openings formed through a tubular member, according to an alternate embodiment of the present invention.

In this example, actuator 92 cooperates with an internal profile 94 mounted along the interior of completion assembly 32, e.g. along the interior of screen assembly 48. One or more internal profiles 94 are positioned such that movement of service tool 58 to a subsequent well zone causes actuator 92 to move against internal profile 94. As the movement of service tool 58 is continued, internal profile 94 forces actuator 92 inwardly which, through appropriate linkage, causes cutters 90 to move radially outward, as illustrated in FIG. 7. The cutters 90 are forced through the tubular member, e.g. base pipe 80, at weakened areas 84 to form the one or more openings 72, as best illustrated in FIG. 8. In this embodiment, openings 72 are formed as longitudinal slots. The internal profile or profiles 94 can be designed to cause cutters 90 to cut through the pipe wall at a plurality of locations. Additionally, internal profile 94 can be designed to rotationally orient converter tool 78 to ensure cutting of openings 72 at the desired locations. If a plurality of screen assemblies 48 are connected, the screen assembly connections can be designed to maintain a desired orientation from one well screen assembly to another. The orientation can be maintained by, for example, timed connections or API connections.

The well system 30 is useful in a variety of applications and in many types of environments. For example, well system 30 can be used to accomplish various well servicing operations in single zone wells or multiple zone wells. Accordingly, the following description and flow chart are provided as an example of a well servicing application in which well system 30, along with converter tool 78, is utilized to selectively form flow openings in specific well zones while maintaining the pressure competence of the system above the treated well zones. However, it should be understood that well system 30 can be used in a variety of other environments, other applications, in cased or open wellbores, and with other or alternate procedures.

Figure 9:
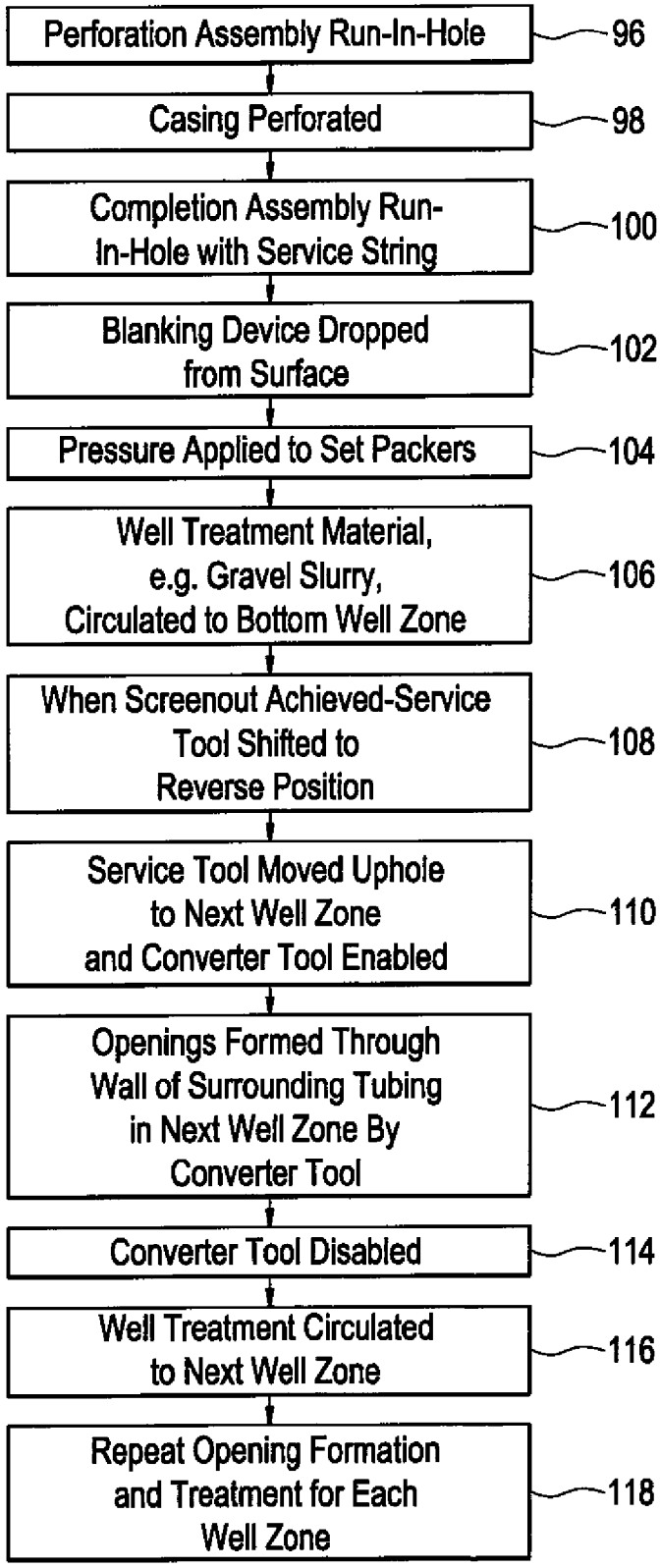
FIG. 9 is a flow chart illustrating one example of a well treatment procedure, according to an embodiment of the present invention.

By way of example, well system 30 can be used in a sequential multi-zone operation in a cased wellbore, as illustrated in the flowchart of FIG. 9. In this example, a perforation assembly is initially run-in-hole, as illustrated by block 96 of the flowchart. Subsequently, the casing 42 is perforated at each well zone 40 to form perforations 44, as illustrated by block 98. Completion assembly 32 is then run-in-hole along with service string 34, as illustrated by block 100. Generally, the service string 34 remains connected to the completion assembly 32 at the upper packer 50 as the completion assembly 32 is moved to the desired location in wellbore 36.

Once the completion assembly 32 is placed on depth, the ball or other blanking device 66 is dropped from the surface, and service string 34 becomes pressure competent, as illustrated by block 102. Pressure is then be applied to the service string 34 to set packer 50 which secures completion assembly 32 to wellbore casing 42. The isolation packers 52 may then be set. By way of example, isolation packers 52 may be set by adjusting service string 34 to a packer setting position and applying tubing pressure within the service string, as illustrated by block 104 of FIG. 9. Then, the service string 34 is placed in a circulating position with exit port 62 positioned adjacent the corresponding circulating port of completion assembly 32. Well treatment material, e.g. gravel slurry, is circulated to the bottom well zone 40, as illustrated by block 106.

If a sand control treatment operation is performed, the gravel slurry is circulated into the lower well zone 40, and gravel is placed in the well zone. When screenout is achieved, service string 34 is shifted to the reverse position and pressure is applied in the wellbore annulus to remove gravel slurry remaining in the service string, as illustrated by block 108. The service tool 58 is then moved uphole and the converter tool 78 is enabled, as illustrated by block 110. The service tool 58 is raised through the next well zone 40 to be treated, thus causing converter tool 78 to interact with internal profiles 94. The result is formation of openings which convert the solid tubular member, e.g. screen assembly base pipe, into fully opened screens, as illustrated by block 112.

The converter tool 78 is then disabled, as illustrated by block 114. This allows well treatment fluid to be circulated into this next well zone via the "just formed" openings 72, thereby enabling the desired flow of treatment fluid, as illustrated by block 116. This process of selectively forming openings to enable treatment of each subsequent well zone while maintaining the pressure competence of the system above the treated well zones can be repeated for the desired number of well zones, as illustrated by block 118.

Figure 10:
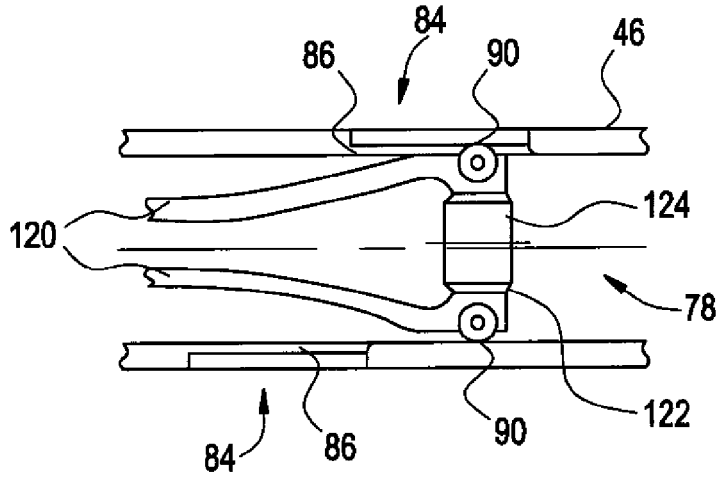
FIG. 10 is an illustration of a converter tool within a completion assembly, according to an alternate embodiment of the present invention.
Figure 11:
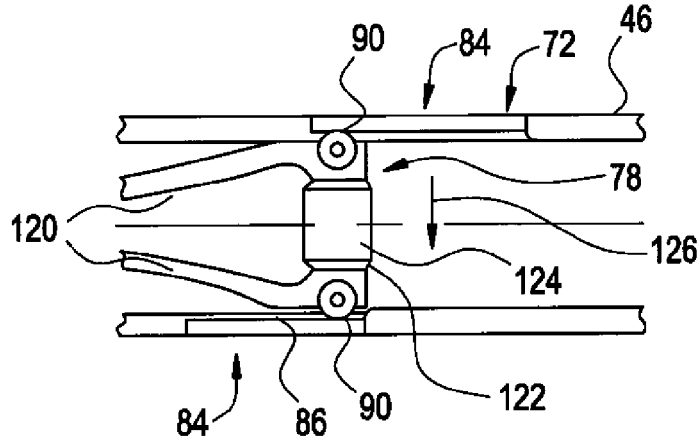
FIG. 11 a view of the converter tool illustrated in FIG. 10 but in a different position of actuation, according to an alternate embodiment of the present invention.
Figure 12:
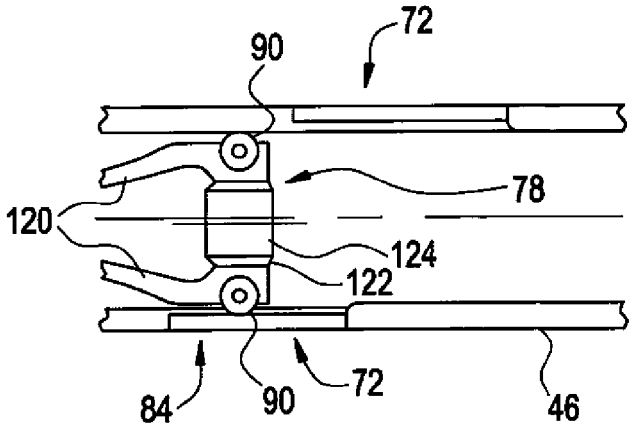
FIG. 12 is a view of the converter tool illustrated in FIG. 10 moved to another position, according to an alternate embodiment of the present invention.

Converter tool 78 can be constructed in a variety of configurations depending on the specific application to which it is applied. Additionally, the converter tool can be designed to cut a variety of different types of openings, including slots, perforations, and other openings. Referring generally to FIGS. 10-12, another embodiment of converter tool 78 is illustrated. In this embodiment, converter tool 78 comprises cutters 90 mounted on arms 120 that may be manipulated to enable or disable the converter tool 78. Two or more cutters 90 are mounted on opposing sides of a structural support 122 which may be in the form of a ring having a flow passage 124 oriented generally axially through the support.

During a cutting operation in which openings 72 are formed, cutters 90 are held at an appropriate distance apart to insure the radial loading at each weakened area 84 is sufficient to form the opening 72 through that weakened area. As illustrated in FIG. 10, for example, movement of converter tool 78 along the interior of tubular member 46 creates a radial load against the lower cutter 90 sufficient to move the upper cutter 90 through the thin wall section 86 illustrated at the top of tubular member 46. As the upper cutter 90 reaches the end of weakened area 84, a radial load in the opposing direction is applied by the thicker wall (or an appropriate profile) of tubular member 46, as illustrated in FIG. 11. At this stage of the cutting operation, opening 72 has been formed through the upper thin wall section 86 to enable fluid flow therethrough as indicated by arrow 126. Continued movement of converter tool 78 causes the lower cutter 90 to cut through the lower thin wall section 86, as illustrated in FIG. 12. Accordingly, another opening 72 is formed through this lower weakened area. By sequentially staggering weakened areas 84, an alternating radial load can be applied to converter tool 78 to form a plurality of openings 72 along a desired section of tubular member 46, e.g. along the lineal extent of a screen assembly base pipe at a particular well zone.

Figure 13:
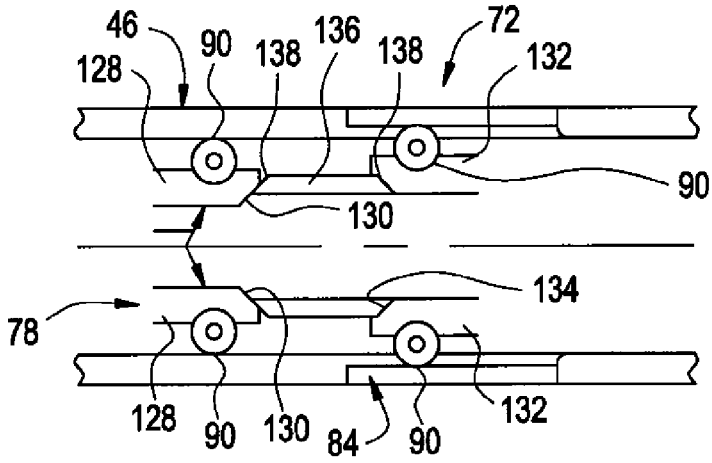
FIG. 13 is an illustration of another type of converter tool positioned in a completion assembly, according to an alternate embodiment of the present invention.

Another embodiment of converter tool 78 is illustrated in FIG. 13. In this embodiment, pairs of cutters 90 are used in cooperation to form sequential openings 72 along tubular member 46. As illustrated, a first pair of cutters 90 are carried on movable structures 128 which each having an inclined surface 130. The first pair of cutters 90 cooperate with a second pair of cutters 90 mounted on movable structures 132 that have corresponding inclined surfaces 134. Inclined surfaces 130 act against inclined surfaces 134 via a load transfer member 136 having cooperating inclined surfaces 138.

When the first pair of cutters 90 is forced radially inward via the normal thick wall section of tubular member 46 or a suitable profile, inclined surfaces 130 act against the cooperating inclined surfaces 138 of load transfer member 136. This forces load transfer member 136 to move in an axial direction and apply an axial load to movable structures 132 of the second set of cutters 90. As load transfer member 136 moves axially, cooperating surfaces 138 act against inclined surfaces 134 of movable structures 132, thereby forcing the second set of cutters 90 in a radially outward direction. The thin wall sections 86 are located such that this radial outward movement causes cutters 90 to cut opening 72 at those particular weakened areas. As the second set of cutters 90 moves past the thin wall sections being cut, the second pair of cutters 90 is forced radially inward by the thick tubing wall. This action causes the axial loading of load transfer member 136 and the consequent radially outward movement of the first pair of cutters 90. By placing weakened areas 84 at the appropriate locations along tubular member 46, this alternating axial loading causes the first set of cutters 90 to cut a second series of openings 72. The alternating loading and cutting of openings 72 can be conducted along a desired length of tubular member 46.

Figure 14:
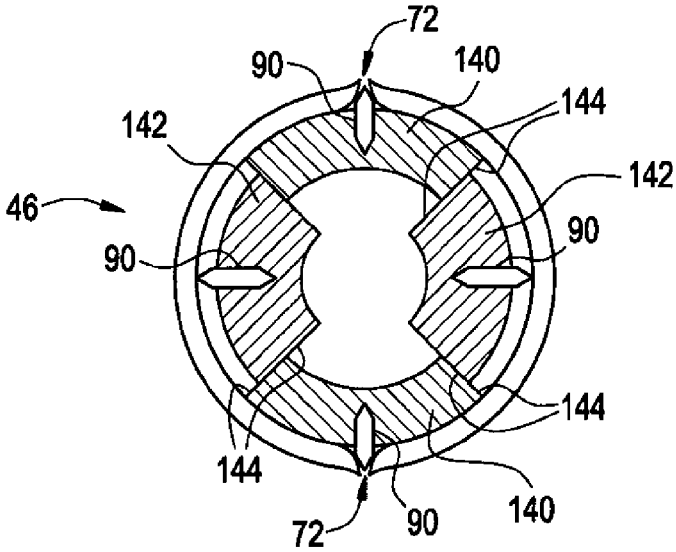
FIG. 14 is an illustration of another type of converter tool positioned in a completion assembly, according to an alternate embodiment of the present invention.

A similar type of alternating formation of openings 72 along tubular member 46 also can be accomplished by radially loading cooperating structures, as illustrated in FIG. 14. In this embodiment, alternating pairs of cutters 90 are mounted on cooperating pairs of wedge blocks 140, 142. Each wedge block 140 has inclined surfaces 144 that slide against inclined surfaces of the adjacent pair of wedge blocks 142, as illustrated. When one pair of wedge blocks, e.g. wedge blocks 142, is radially loaded and moved radially inward, cooperating inclined surfaces 144 force the pair of wedge blocks 140 in a radially outward direction. This movement forces cutters 90 through the wall of tubular member 46, e.g. through screen assembly base pipe 80, to create openings 72. The normal wall thickness or an appropriate profile along tubular member 46 can be used to provide adequate radial force against one pair of wedge blocks to drive the cooperating pair of wedge blocks radially outward to form the openings. By properly staggering weakened areas 84, an alternating radial load can be applied to the pairs of wedge blocks 140, 142 to form a plurality of openings 72 along a desired section of tubular member 46.

Figure 15:
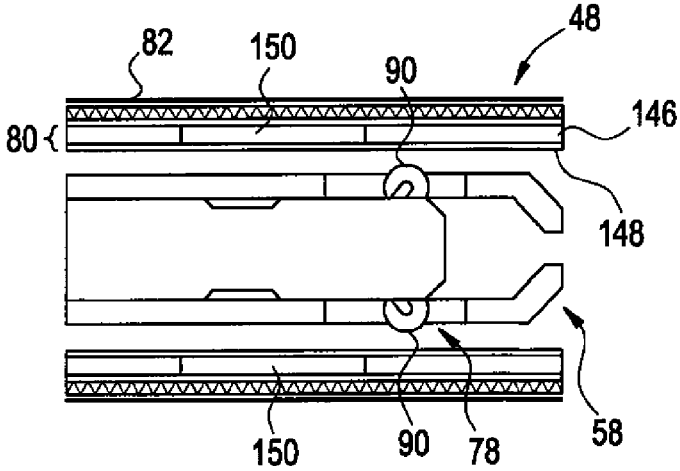
FIG. 15 is an illustration of another example of a well assembly having a converter tool mounted on a service tool within a completion assembly, according to an alternate embodiment of the present invention.
Figure 16:
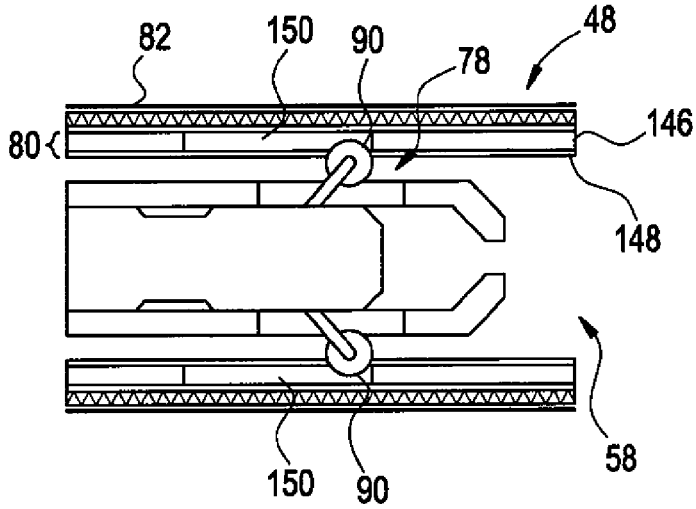
FIG. 16 is an illustration similar to that of FIG. 15 in which the converter tool has been actuated, according to an alternate embodiment of the present invention.
Figure 17:
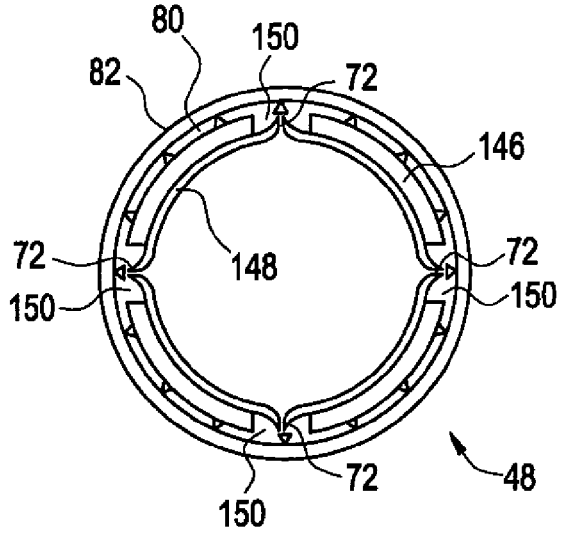
FIG. 17 is a cross-sectional view of the well assembly illustrated in FIG. 16 with openings formed through a tubular member, according to an alternate embodiment of the present invention.

In another alternate embodiment, tubular member 46 can be constructed as a composite tubular, as illustrated in FIGS. 15-17. In the embodiment illustrated, tubular member 46 comprises a screen assembly 48 having base pipe 80 with a structural wall 146 and a pressure containing membrane 148 positioned along a surface, e.g. an interior surface, of structural wall 146. One or more passages 150 are formed generally radially through structural wall 146, and pressure containing membrane 148 initially covers the passages 150 to maintain pressure competence, as illustrated in FIG. 15. Other types of pressure containing layers also can be used in appropriate well applications.

In this embodiment, converter tool 78 and cutters 90 are used to cut through the pressure containing membrane 148 in proximity to passages 150, as illustrated in FIG. 16. The types of cutters and the method for actuating the cutters can be similar to that described with respect to the non-membrane embodiments although the pressure containing membrane 148 may reduce the force required to form opening 72 in some applications. Once cutters 90 cut through pressure containing membrane 148 in the appropriate locations, the pressure integrity is removed and radial flow paths are created through the tubular member 46 via openings 72, as illustrated in FIG. 17. By way of example, pressure containing membrane 148 can be hydro-formed along the interior of base pipe structural wall 146 to minimize any gaps between the membrane and the base pipe. Additionally, seals can be provided at each end of the membrane to ensure the final screen assembly is pressure competent.

Figure 18:
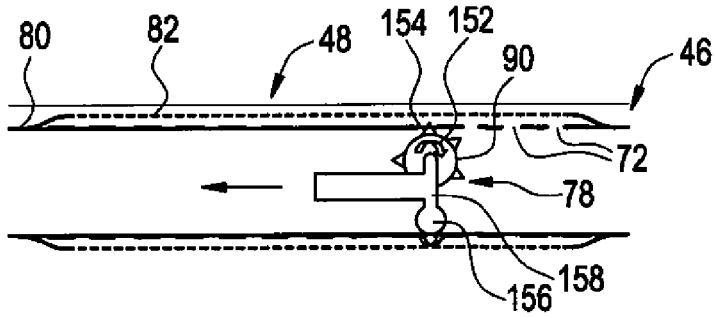
FIG. 18 is an illustration of another type of converter tool, according to an alternate embodiment of the present invention.

Converter tool 78 can be designed to cut a variety of openings 72 through a variety of tubular members 46. As illustrated in FIG. 18, cutter 90 can be designed to cut openings 72 in the form of perforations through a screen assembly base pipe or other tubular member. In this embodiment, cutter 90 comprises a roller 152 having protruding cutters 154 that cut perforations through the tubular member as roller 152 is rolled along an inner surface of the tubular member. A cooperating roller 156 rolls along an opposite side of the tubular member 46 and places roller 152 and protruding cutters 154 under a sufficient radial load via a link 158 connected between roller 156 and roller 152. Alternatively, the converter tool 78 can be designed to puncture the tubular member with a protruding cutter, and then the cut can be extended by displacing the protruding cutter along the inside diameter of the tubular member to extend the cut.

Figure 19:
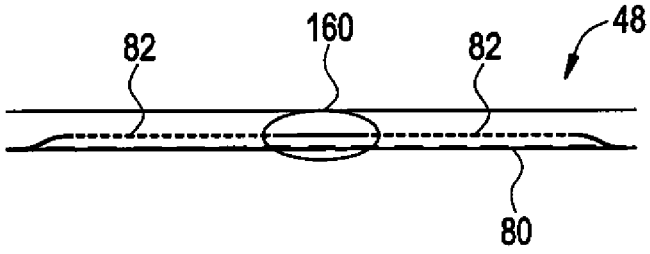
FIG. 19 is an illustration of a portion of a screen assembly initially having a solid base pipe, according to an embodiment of the present invention.
Figure 20:
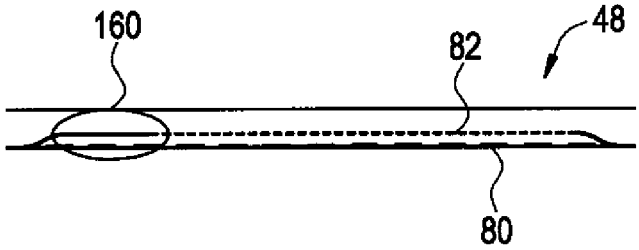
FIG. 20 is an illustration of a portion of an alternate screen assembly initially having a solid base pipe, according to an alternate embodiment of the present invention.
Figure 21:
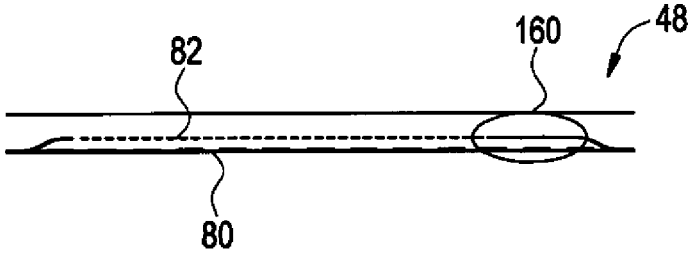
FIG. 21 is an illustration of a portion of an alternate screen assembly initially having a solid base pipe, according to an alternate embodiment of the present invention.

In some well screen assembly applications, a contingency target area 160 can be located separate from the screen jacket section 82, as illustrated in FIGS. 19-21. This approach provides an alternate mechanism for creating apertures in the base pipe 80 in that apertures can be formed at the contingency target area 160 without damaging screen jacket section 82. By way of example, the contingency target area 160 can be positioned at a middle region of the screen assembly 48, as illustrated in FIG. 19. Alternatively, the contingency target area 160 can be positioned proximate a top region (FIG. 20) or proximate a bottom region (FIG. 21) of screen assembly 48.

Figure 22:
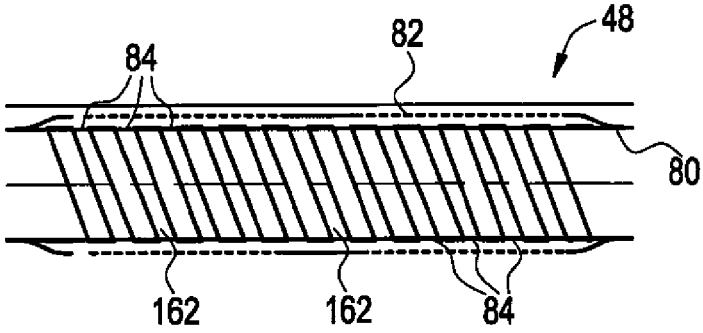
FIG. 22 is an illustration of a tubular member having a recessed flow path connecting a plurality of thin wall sections that can be cut with a converter tool, according to an alternate embodiment of the present invention.

In another embodiment, the base pipe 80 or other tubular member 46 can be formed with a recessed flow path 162 to facilitate fluid flow along the tubular member, as illustrated in FIG. 22. The recessed flow path 162 can be routed to connect openings 72 (or potential openings 72 prior to cutting) to maximize use of the flow openings created through the tubular member. If, for example, apertures in the base pipe of a well screen assembly are not connected with all of the openings between the rib wires of the screen jacket 82, the recessed flow path 162 ensures that all screen jacket cavities are in communication.

The embodiments described above provide examples of well systems in which openings may selectively be formed to enable flow at sequential well zones while maintaining the pressure competence of the completion assembly above the region of interest. A converter tool enables the selective formation of openings while maximizing the completion assembly inside diameter and eliminating the need for complex or flow restricting devices. The converter tool can be designed to form openings by deforming the material of selected members through cutting or other deformation techniques. Depending on the specific application, however, the design and arrangement of the completion assembly and the converter tool can be changed. The number, size and shape of the openings formed through a tubular member of the completion assembly also can be adjusted. Similarly, the design, shape and size of the service tool and cutter tool can be selected according to the parameters of a given well operation. Additionally, the axial and/or radial loads applied to cut the desired openings can be created mechanically, by increased pressure, or through other loading techniques.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of performing a well servicing operation, comprising:

preparing a completion assembly with a plurality of screen assemblies arranged to be positioned proximate a plurality of corresponding well zones;

deploying the completion assembly and a service string downhole into a multi-zone wellbore;

maintaining the pressure competence of screen assemblies uphole from a well zone during treatment of the well zone;

moving the service string to a subsequent well zone;

deforming an opening through a solid base pipe of a subsequent screen assembly positioned at the subsequent well zone by mechanically actuating a converter tool mounted on the service string through movement of the service string, thus selectively interrupting the pressure competence of the subsequent screen assembly; and using the service string to deliver a well service material to the subsequent well zone.

2. The method as recited in claim 1, wherein deforming comprises utilizing a mechanical cutter on the service string to cut a slot through a wall of the solid base pipe.

3. The method as recited in claim 1, wherein deforming comprises utilizing a mechanical cutter to cut a perforation in a wall of the solid base pipe.

4. The method as recited in claim 1, further comprising forming each solid base pipe with a thin wall section through which the opening is formed.

5. The method as recited in claim 1, wherein maintaining comprises maintaining pressure competence during a sand control treatment at the well zone.

6. The method as recited in claim 1, wherein maintaining comprises forming the solid base pipe with a pressure containing membrane.

7. The method as recited in claim 1, wherein moving comprises moving the service string through an internal profile on the completion assembly to actuate a cutter for cutting the opening.

8. The method as recited in claim 1, wherein deforming comprises actuating a mechanical cutter by applying a radial load.

9. The method as recited in claim 1, wherein deforming comprises actuating a mechanical cutter by applying an axial load.

10. A method, comprising:

moving a tubular member into a wellbore for a well service operation;

maintaining pressure integrity of the tubular member during an initial well procedure;

forming an opening through a solid wall of the tubular member while downhole without using an explosive charge, the opening being formed to break the pressure integrity and enable fluid flow through the opening;

wherein moving comprises moving a completion assembly having a plurality of sand screen assemblies into the wellbore; and wherein forming comprises providing a service tool with a converter tool and moving the service tool through each of the plurality of sand screen assemblies to sequentially cut openings in a base pipe of each of sand screen assembly.

11. The method as recited in claim 10, wherein forming comprises forming a plurality of openings.

12. The method as recited in claim 10, wherein maintaining pressure integrity comprises maintaining pressure integrity during a sand control procedure in a well zone located further downhole.

13. The method as recited in claim 10, wherein forming comprises forming openings in a sequential well zone following a well service operation in a preceding well zone.

14. A system, comprising:

a completion assembly positioned in a wellbore, the completion assembly having a tubular member;

a service string having a service tool with a flow passage to direct fluid flow, the service tool being movable along an interior of the completion assembly; and a converter tool mounted on the service tool, the converter tool being selectively actuated to force an opening through a wall of the tubular member.

15. The system as recited in claim 14, wherein the completion assembly comprises a plurality of sand screen assemblies position at a plurality of well zones, each sand screen assembly comprising the tubular member in the form of a solid base pipe.

16. The system as recited in claim 14, wherein the converter tool is actuated to cut slots through the tubular member.

17. The system as recited in claim 14, wherein the converter tool is actuated to cut perforations through the tubular member.

18. The system as recited in claim 14, wherein the completion assembly comprises an internal profile positioned to engage the converter tool and initiate formation of the opening.

19. The system as recited in claim 14, wherein the tubular member comprises a thin wall section through which the opening is formed.

20. The system as recited in claim 14, wherein the converter tool is selectively actuated by applying a load.

21. A system for servicing a well, comprising:

a completion assembly having a plurality of sand screens, each sand screen having a solid base pipe to maintain pressure integrity;

a service tool movable through the solid base pipes to enable treatment of a plurality of well zone; and a converter tool positioned for movement with the service tool to form openings through selected solid base pipes once pressure integrity is no longer required.

22. The system as recited in claim 21, wherein each solid base pipe comprises a weakened area through which an opening may be formed by the converter tool.

23. The system as recited in claim 21, wherein each solid base pipe comprises a plurality of passages and a pressure containing membrane through which openings may be formed to enable radial flow through the plurality of passages.

* * * * *